United States Patent [19]

Watanabe et al.

[11] 4,146,759

[45] Mar. 27, 1979

[54] IGNITION DISTRIBUTOR

[75] Inventors: Akikazu Watanabe, Tokyo; Kazuyoshi Okada, Yokohama; Masazumi Sone, Chigasaki, all of Japan

[73] Assignee: Nissan Motor Company, Limited, Japan

[21] Appl. No.: 823,499

[22] Filed: Aug. 10, 1977

[30] Foreign Application Priority Data

Aug. 12, 1976 [JP] Japan ..... 51-95385

[51] Int. Cl.[2] ..... H01H 1/00; H01H 19/00

[52] U.S. Cl. ..... 200/19 R; 200/19 DR; 200/262; 200/267; 200/268; 338/327

[58] Field of Search ..... 200/19 R, 19 A, 19 DC, 200/19 DR, 267, 268, 269, 262, 265, 266; 338/66, 307, 308, 309, 327

[56] References Cited

U.S. PATENT DOCUMENTS

| | | | |
|---|---|---|---|
| 2,037,524 | 4/1936 | Mahaffey | 200/19 DR |
| 2,790,020 | 4/1953 | Redick et al. | 200/19 DR X |
| 2,818,354 | 12/1957 | Pritikin et al. | 338/309 X |
| 3,361,886 | 1/1968 | Prickett | 200/19 DR X |
| 3,474,304 | 10/1969 | Currin et al. | 338/309 X |
| 3,501,600 | 3/1970 | Saulmon | 200/19 A |
| 3,914,514 | 10/1975 | MacKenzie et al. | 338/309 |
| 4,007,342 | 2/1977 | Makino et al. | 200/19 DR X |
| 4,039,787 | 8/1977 | Hori et al. | 200/19 DR X |
| 4,043,030 | 8/1977 | Onishi et al. | 200/19 DR X |
| 4,053,866 | 10/1977 | Merz et al. | 338/327 X |

*Primary Examiner*—James R. Scott

*Attorney, Agent, or Firm*—Lane, Aitken & Ziems

[57] ABSTRACT

An ignition distributor for automotive vehicles comprises a shaft, a rotor arm mounted on the shaft for rotation therewith, a stationary center electrode mounted coaxially with the shaft, and a plurality of angularly spaced stationary outer electrodes. A contact member is secured to the rotor arm which extends between the center of the shaft and a point adjacent to the outer electrode and comprises a baseplate secured to the rotor arm and a resistive film secured to the baseplate, the latter being in electrical contact with the center electrode and in radially inwardly spaced from the outer electrode such that a sudden breakdown of air occurs when the outer end of the contact plate is positioned in proximity to the outer electrode generating an electric discharge. The baseplate is composed of a material having lower electrical conductivity than that of the resistive film so that a distributed constant RC transmission path is formed along the passage of the discharge current.

19 Claims, 9 Drawing Figures

IGNITION DISTRIBUTOR

FIELD OF THE INVENTION

The present invention relates generally to ignition distributors and particularly to the improvement to the ignition pulse generating mechanism of the distributor.

BACKGROUND OF THE INVENTION

The ignition distributor generally comprises a rotor having an arm projecting from the center of rotation to the circumference of the distributor cap. At the center of rotation, the rotor arm is in electrical contact with a center electrode secured to the center of the cap and at the outer end the rotor arm is spaced from each one of outer electrodes mounted on the inner circumference of the cap. As the rotor turns a sudden breakdown of air occurs in the air gap between the rotor and stator outer electrodes generating a short-duration electric discharge or spark which lasts for a period of the order of nanoseconds, and which is a source of radio interference. An approach to the suppression of such radio interference involves the use of a coiled resistance element as the rotor arm which attenuates the flow of current generated as the result of the electric discharge. Another disadvantage encountered with the prior art approach is that the coiled structure is liable to electrical disconnection due to vehicle vibration, and hinders mass production because of its structural complexity.

SUMMARY OF THE INVENTION

The primary object of the invention is therefore to provide an improved ignition distributor which is free from operation causing radio interference.

Another object of the invention is to provide an ignition distributor which is simple in construction and particularly applicable for mass production.

A further object of the invention is to provide an ignition distributor with a contact arm which assures an improved durability.

These objects are achieved by an ignition distributor which comprises a shaft, a rotor arm mounted on the shaft for unitary rotation therewith, a center electrode mounted coaxially with the shaft, at least one outer electrode spaced from an outer end of the rotor arm, a baseplate secured to the rotor arm and an electrical resistive film secured to the baseplate and in electrical contact with the center electrode and spaced radially inwardly from the outer electrode so that there is a sudden breakdown of air therebetween to generate an electrical discharge when an outer end portion of the resistive film is positioned in proximity to the outer electrode. The resistive film thereby forms a distributed constant RC circuit with the rotor arm through the baseplate to carry an electric current resulting from said electrical discharge. Also, the baseplate has electrical conductivity lower than the electrical conductivity of the resistive film and a relatively high thermal conductivity.

The distributed constant resistive circuit formed by the resistive film serves as a lossy transmission line for the high frequency components of the generated spark discharge of the duration of order of nanoseconds. Preferably, the baseplate is composed of metallic oxide such as beryllium oxide, aluminum oxide or ferrite. Because of the high thermal conductivity of such materials, the heat generated in the resistive film is dissipated easily to the ambient air. The use of ferrite as the baseplate permits it to serve as a distributed constant inductive circuit along the passage of the resistive film so that the total inductance of the resistive film is increased to advantage in that the radio interference is effectively suppressed.

BRIEF DESCRIPTION OF THE DRAWINGS

These and other objects, features and advantages of the invention will be understood from the following description taken in conjunction with the accompanying drawings, in which.

DESCRIPTION OF THE PREFERRED EMBODIMENTS

Figure 1:
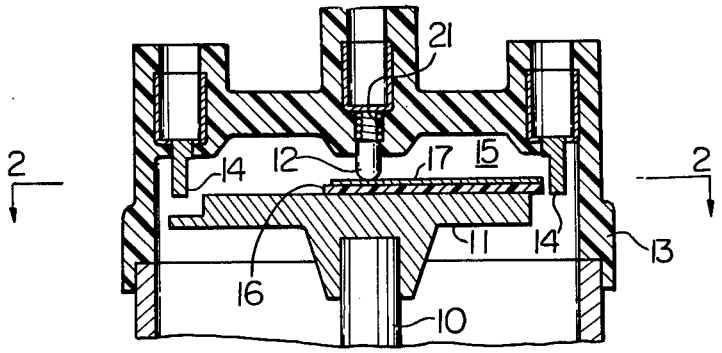
FIG. 1 is a cross-sectional view of an ignition distributor embodying the present invention.
Figure 2:
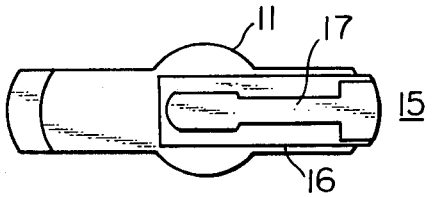
FIG. 2 is a cross-sectional view taken along the lines 2—2 of FIG. 1.

In FIGS. 1 and 2, the pulse generating mechanism of an ignition distributor embodying the invention is illustrated. The distributor comprises a conductive metal shaft 10 for rotation with the crankshaft of an automotive vehicle, a conductive metallic rotor arm 11 mounted on the metal shaft 10 which is electrically connected to the chassis of the vehicle, a center electrode 12 mounted on a cap 13 coaxially with the shaft 10 and a plurality of angularly spaced outer electrodes 14 mounted on the cap radially outwardly from the outer edge of the rotor arm 11. A high voltage will be supplied across the center electrode 12 and the outer electrode 14 from a source not shown. On the upper surface of the rotor arm 11 is secured a contact member 15 which is in electrical contact with the center electrode 12 and is spaced from the outer electrodes 14 such that there is a sudden breakdown of air between the electrode 14 and the contact member 15 when the latter is positioned in proximity to the former, thereby generating an electric discharge or spark of the order of nanoseconds in duration.

In accordance with the present invention, the contact member 15 comprises a baseplate 16 having properties of high thermal conductivity and low electrical conductivity as well as a high melting point is exhibited by metallic oxides such as alluminum oxide and beryllium oxide, and preferably having additional property of high permeability as exhibited by ferrite. On the baseplate 16 is provided a film 17 of electrically resistive material by depositing a pasty compound composed of a mixture of ruthenium oxide and glass frit or a mixture of silver, palladium and glass frit. Such pasty compound is known as type DP-1300 and available from Du Pont Corporation. The deposition can be achieved by using the method employed in printing or spraying the paste onto the baseplate through a mask having a desired pattern. The applied paste is then baked at a temperature in a range from 700° C. to 900° C. It is noted that the electrical conductivity of the baseplate 16 is much lower than the electrical conductivity of the resistive film and the thermal conductivity is sufficiently high so that the baseplate 16 serves as a dielectric between the resistive film 17 and the rotor arm 11 as well as a thermal sink for dissipating the heat produced in the resistive film due to the discharge current as well as an insulator for isolating the resistive electrical path from the rotor arm 11. Additionally, the baseplate 16 is composed of such a metallic oxide having a higher melting point than 900° C. that the resistive film of the type as described above is permitted to be baked at such high temperatures without deteriorating the physical properties of the baseplate.

The resistive film 17 and the rotor arm 11 with the baseplate 17 therebetween constitute a distributed constant RC transmission line for the high frequency components of the spark current. Therefore, the effect of radio interference can be suppressed to a minimum. When ferrite is used as the baseplate material, the baseplate then serves as a distributed constant inductive circuit which serves to increase the inductance of the transmission line, whereby the radio interference can be further eliminated.

Since the baseplate 16 has a high thermal conductivity, the heat produced in the resistive film 17 is dissipated through the baseplate 16 through the rotor arm 11 to the ambient air, whereby the resistive film can attain a power density of up to 30 milliwatts/mm$^2$. The thickness of the resistive film 16 may range from 20 to 50 micrometers. However, it can be increased as necessary to a range from 100 to 200 micrometers.

Figure 3:
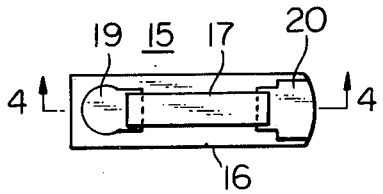
FIG. 3 is a modification of the embodiment of FIG. 2.
Figure 4:
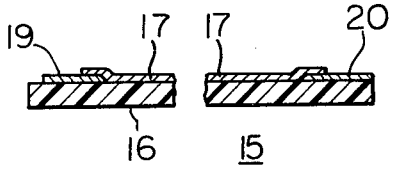
FIG. 4 is a cross-sectional view taken along the lines 4—4 of FIG. 3.

FIGS. 3 and 4 illustrate a modification of the previous embodiment in which a conductive film 19 is provided on one end of the baseplate 16 so as to be in electrical contact with the center electrode 12 and another conductive film 20 is provided on the opposite end of the baseplate so as to be in opposed relation with the outer electrode 14. Each of the conductive films preferably comprises a mixture compound of silver and palladium or a mixture compound of platinum and silver. The resistive film 17 is deposited on the baseplate 16 in the same manner as previously described with the exception that the opposite ends of the resistive film partially overlap the conductive films 19 and 20. The provision of the conductive film 19 serves to reduce electrical contact resistive between contact member 15 and center electrode 12 and the provision of the conductive film 20 serves to facilitate the transfer of electrical energy between the contact arm and electrode 14.

It is to be noted that the material that constitutes the center electrode 12 is preferably softer than the material of the contacting film for the purpose of prolonging the usable life span of the contact member 15. The center electrode 12 is urged by a spring coil 21 shown in FIG. 1 into pressure contact with the opposed contacting surface so that the loss of contact resulting from use may be compensated.

Figure 5:
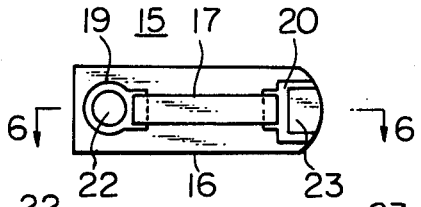
FIG. 5 is a modification of the embodiment of FIG. 3.
Figure 6:
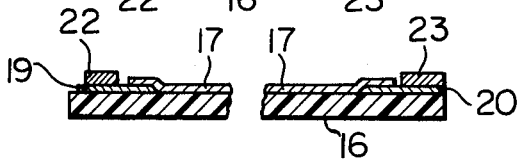
FIG. 6 is a cross-sectional view taken along the lines 6—6 of FIG. 5.

The usable life of the contact member 15 can be further extended by providing a metal strip such as brass or aluminum 22 on the conductive film 19 and another metal strip 23 of the same material as strip 22 on the conductive film 20 as illustrated in FIGS. 5 and 6. The upper metal strip 22 minimizes wear from friction and assures good electrical contact with the center electrode 12 for an extended period of time. The metal strip 23 also serves to minimize wear from the high temperature spark and assures good energy transfer characteristic over extended period of time.

Figure 7:
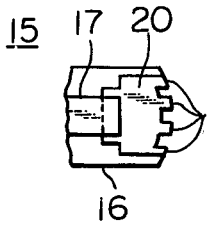
FIG. 7 is a further modification of FIG. 2.

A modification of the embodiment of FIG. 3 is shown in FIG. 7 in which the outer end of the contact member 15 is shaped to provide a plurality of teeth 24 which increase the surface of the energy transfer areas so that the electrical discharge tends to disperse, thereby further reducing the effect of radio interference. The modification of FIG. 7 can also be applied to the embodiment of FIG. 5.

Figure 8:
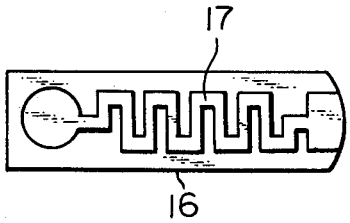
FIGS. 8 and 9 are still further modifications of FIG. 2.
Figure 9:
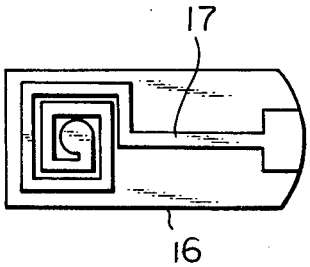

In a modification of FIG. 2 shown in FIG. 8, the resistive film 17 is shaped into a zigzag or meandering pattern so that the length of the path through which spark current flows is greater than the distance between the center electrode 12 and the outer electrode 14. The extended path length of the resistive film 17 serves to enhance the distribution of the resistive components over extended area so that the resistive film constitutes a satisfactory distributed constant circuit and results in a further reduction of radio interference. FIG. 9 is a modified form of the embodiment of FIG. 8 in which the resistive film 17 is in a substantially spiral form in the area adjacent to the center electrode 12 and extends toward the outer edge over a straight path.

A further characterizing feature of the invention resides in the fact that the use of the electrical resistive paste compound permits mass production of the contact member and the baking process involving the temperature in the range from 700° to 900° C. permits the contact member to withstand the temperatures which will be encountered during use. In addition, the simplied construction of the contact member ensures operation with a minimum possibility of failures.

The foregoing description shows only preferred embodiments of the present invention. Various modifications are apparent to those skilled in the art without departing from the scope of the present invention. For example, the resistive film can be applied in various ways to the baseplate in such a manner as to form a desired pattern using the printing technique or methods known in the related fields. The scope of protection of the invention is only limited by the appended claims. Therefore, the embodiments shown and described are only illustrative, not restrictive.

What is claimed is:

1. An ignition distributor comprising, a metallic rotary shaft, a laterally extending metallic arm mounted on said shaft for unitary rotation therewith, a stationary center electrode disposed coaxially with said shaft, at least one stationary outer electrode spaced from the edge of said lateral arm to define an air gap therewith, a baseplate overlying a surface of said lateral arm, a resistive film secured to said baseplate and in electrical contact with said center electrode, wherein the electrical conductivity of said baseplate is lower than that of said resistive film so that a distributed constant RC circuit is defined by said resistive film, said baseplate and the metallic parts of said distributor including said metallic lateral arm and said rotary shaft to carry an electric current resulting from a spark discharge generated across said air gap in response to said arm rotating past said outer electrode.

2. An ignition distributor as claimed in claim 1, wherein said baseplate has a higher melting point than the melting point of said resistive film.

3. An ignition distributor as claimed in claim 2, wherein said baseplate is formed of a metallic oxide.

4. An ignition distributor as claimed in claim 3, wherein said metallic oxide is aluminum oxide.

5. An ignition distributor as claimed in claim 3, wherein said metallic oxide is beryllium oxide.

6. An ignition distributor as claimed in claim 2, wherein said baseplate has a property of high permeability.

7. An ignition distributor as claimed in claim 6, wherein said baseplate is formed of ferrite.

8. An ignition distributor as claimed in claim 1, wherein said resistive film is formed of a mixture compound comprising ruthenium oxide and glass frit.

9. An ignition distributor as claimed in claim 1, wherein said resistive film is formed of a mixture compound comprising silver, palladium and glass frit.

10. An ignition distributor as claimed in claim 1, further comprising an electrical conductive member on said baseplate adjacent to said outer electrode and in electrical contact with one end of said resistive film.

11. An ignition distributor as claimed in claim 10, wherein said conductive member and baseplate include a plurality of segmented sections extending toward said outer electrode.

12. An ignition distributor as claimed in claim 11, further comprising a second electrical conductive member on said baseplate and in electrical contact with said center electrode and in electrical contact with the opposite end of said resistive film.

13. An ignition distributor as claimed in claim 12, wherein each of said first and second electrical conductive members is formed of a metallic compound comprising a mixture of silver and palladium.

14. An ignition distributor as claimed in claim 12, wherein each of said first and second electric conductive members is formed of a metallic compound comprising a mixture of platinum and silver.

15. An ignition distributor as claimed in claim 13, further comprising a brass member secured to each of said first and second metallic members.

16. An ignition distributor as claimed in claim 13, further comprising an aluminum member secured to each of said first and second metallic members.

17. An ignition distributor as claimed in claim 1, wherein said resistive film has a longer electrical path than the distance between said center and outer electrodes.

18. An ignition distributor as claimed in claim 17, wherein said resistive film has a meandering shape.

19. An ignition distributor as claimed in claim 17, wherein said resistive film has a substantially spiral pattern.

* * * * *